US009166378B2

(12) United States Patent
Alfonso et al.

(10) Patent No.: US 9,166,378 B2
(45) Date of Patent: Oct. 20, 2015

(54) SPARK PLUG, IN PARTICULAR SWIRL CHAMBER SPARK PLUG

(71) Applicants: Jorge Diaz Alfonso, Fellbach, DE (US); Hermann Kersting, Ludwigsburg (DE)

(72) Inventors: Jorge Diaz Alfonso, Fellbach, DE (US); Hermann Kersting, Ludwigsburg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/379,049

(22) PCT Filed: Jan. 2, 2013

(86) PCT No.: PCT/EP2013/050016

§ 371 (c)(1),
(2) Date: Aug. 15, 2014

(87) PCT Pub. No.: WO2013/120632

PCT Pub. Date: Aug. 22, 2013

(65) Prior Publication Data

US 2015/0028737 A1 Jan. 29, 2015

(30) Foreign Application Priority Data

Feb. 16, 2012 (DE) ..... 10 2012 202 335

(51) Int. Cl.

| | |
|---|---|
| ***H01T 13/20*** | (2006.01) |
| ***H01T 13/26*** | (2006.01) |
| ***H01T 13/46*** | (2006.01) |
| ***H01T 13/12*** | (2006.01) |
| ***H01T 13/32*** | (2006.01) |

(52) U.S. Cl.

CPC ..... *H01T 13/26* (2013.01); *H01T 13/12* (2013.01); *H01T 13/32* (2013.01); *H01T 13/467* (2013.01)

(58) Field of Classification Search

CPC ..... H01T 13/39; H01T 13/32
USPC ..... 313/118, 125, 140, 141
See application file for complete search history.

(56) References Cited

U.S. PATENT DOCUMENTS

| | | | | |
|---|---|---|---|---|
| 2,129,003 | A | 9/1938 | Grant | |
| 2,900,546 | A | 8/1959 | Russell | |
| 3,320,461 | A | 5/1967 | Feins | |
| 5,369,328 | A * | 11/1994 | Gruber et al. | 313/141 |
| 2002/0055318 | A1 | 5/2002 | Ishiguro et al. | |
| 2002/0180326 | A1 * | 12/2002 | Francesconi et al. | 313/140 |

FOREIGN PATENT DOCUMENTS

| | | |
|---|---|---|
| GB | 234 522 | 12/1925 |
| GB | 418 545 | 10/1934 |

OTHER PUBLICATIONS

International Search Report for PCT/EP2013/050016, dated Mar. 14, 2013.

* cited by examiner

*Primary Examiner* — Joseph L Williams
(74) *Attorney, Agent, or Firm* — Kenyon & Kenyon LLP

(57) ABSTRACT

A spark plug includes: a center electrode having at least one first spark surface and extending along a longitudinal axis of the spark plug; and a ground electrode having at least one second spark surface, the first spark surface being situated diametrically opposed to the second spark surface, so that an ignition spark may be generated between the first and second spark surfaces, the center electrode being rotatable coaxially to the longitudinal axis with respect to the ground electrode, and the first and second spark surfaces being inclined in such a way that rotating the center electrode with respect to the ground electrode makes it possible to set a distance between the first and second spark surfaces.

11 Claims, 3 Drawing Sheets

FIG. 3
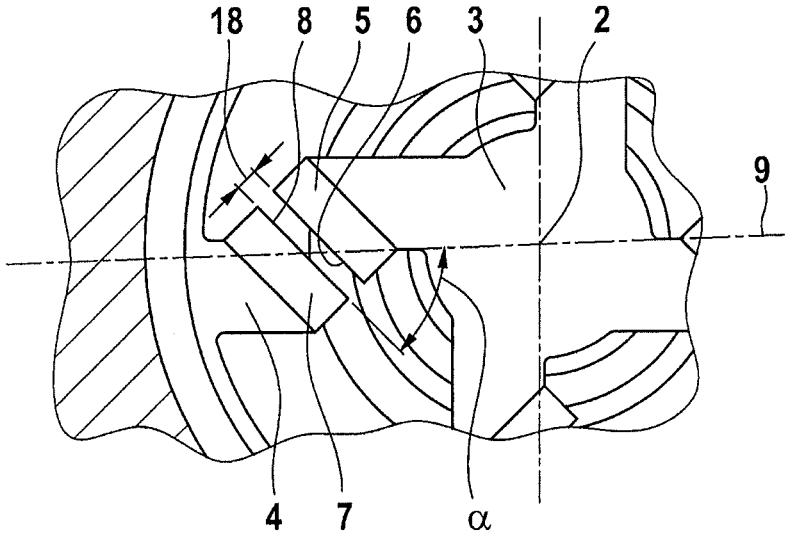
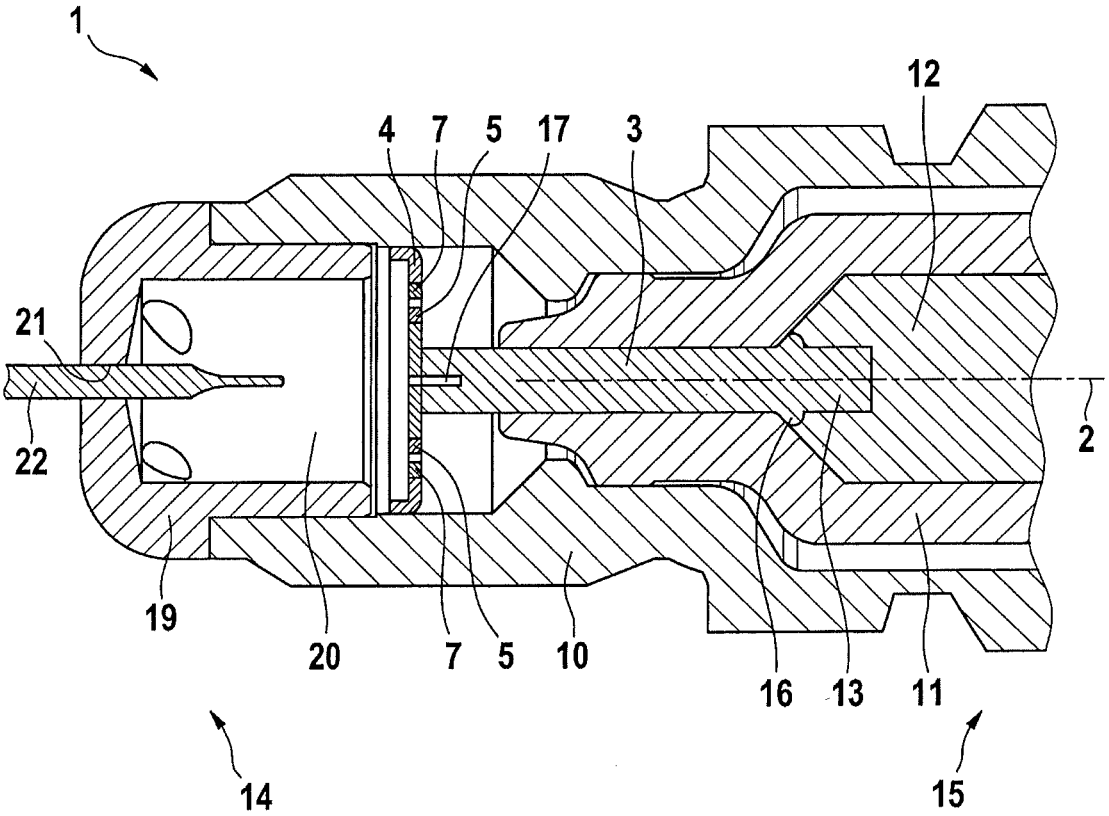
FIG. 4

SPARK PLUG, IN PARTICULAR SWIRL CHAMBER SPARK PLUG

BACKGROUND OF THE INVENTION

1. Field of the Invention

The present invention relates to a spark plug, e.g., a swirl chamber spark plug used for stationary gas engines.

2. Description of the Related Art

Known swirl chamber spark plugs are primarily used in large gas engines. In these spark plugs, the service life of the spark plug is a decisive economic and technical factor, since the spark plugs themselves and their replacements are relatively expensive. In known swirl chamber spark plugs, the precious metal surfaces of the electrodes, on which the sparks are produced, are designed to be as large as possible. A large amount of costly precious metal must be used in this case, since it is not possible to take advantage of the material thickness. Furthermore, it is not possible to readjust the distances of the electrodes in known swirl chamber spark plugs, since the cap that forms or closes the swirl chamber does not allow access to the electrodes. FIG. 1 shows a swirl chamber spark plug 30 in a section perpendicular to the longitudinal axis. A center electrode 3 and a ground electrode 4 are visible. Four spark surfaces 31 are formed on each center electrode 3 and ground electrode 4. Spark surfaces 31 are situated on small precious metal plates. In known swirl chamber spark plug 30, the distance between spark surfaces 31 is neither settable nor readjustable.

BRIEF SUMMARY OF THE INVENTION

The spark plug according to the present invention makes it possible to set or readjust the gap between the spark surfaces, which makes it possible to design the used small precious metal plates to be smaller. This may reduce the manufacturing costs of the spark plug and simultaneously increase the service life or useful life of the spark plug, so that the cost-benefit ratio is improved. All of these advantages are achieved by a spark plug including a center electrode extending along a longitudinal axis of the spark plug, the center electrode including at least one spark surface, and a ground electrode including at least one second spark surface. The first spark surface is situated diametrically opposed to the second spark surface in such a way that an ignition spark may be generated between the two spark surfaces. The center electrode is rotatable coaxially to the longitudinal axis with respect to the ground electrode and/or the ground electrode is rotatable coaxially to the longitudinal axis with respect to the center electrode. Furthermore, the first spark surface and the second spark surface are inclined in such a way that rotating the center electrode with respect to the ground electrode and/or rotating the ground electrode with respect to the center electrode makes it possible to set a distance between the first spark surface and the second spark surface, i.e., it is alterable. The center electrode is, of course, insulated with respect to the ground electrode, so that when a current is applied, the ignition spark is produced between the particular spark surfaces.

A plane is defined for the definition of the inclination of the spark surfaces. In this plane lies the longitudinal axis of the spark plug, and this plane bisects the center of the particular spark surface. Preferably, the first spark surface and the second spark surface diametrically opposed to it are inclined to this plane at an angle>0. Preferably, this angle is between 5° and 90°. In particular, this angle is preferably between 30° and 60°. Furthermore, the diametrically opposed spark surfaces are each situated in parallel to one another. Thus, at least in the delivery state of the spark plug, this results in a uniform distance across the entire surface of the spark surfaces.

Furthermore, it is preferably provided that the first spark surface is formed on a first small precious metal plate of the center electrode, and the second spark surface is formed on a second small precious metal plate of the ground electrode. These small precious metal plates are an integral part of the particular electrode so that rotating the particular electrode causes the small precious metal plates and the spark surfaces formed on them to rotate as well.

Furthermore, it is preferably provided that the first spark surface and the second spark surface are planar or rounded surfaces.

Preferably, multiple first spark surfaces distributed on the center electrode and multiple second spark surfaces distributed on the ground electrode may be formed. It is particularly preferred that one small precious metal plate is provided for each spark surface. Furthermore, each pairing of a first spark surface and a second spark surface has the same distance. Furthermore, all spark surfaces are preferably situated in such a way that they have the same inclination, so that when the distance is adjusted on each pair of spark surfaces, the same distance prevails continuously.

In order to design the center electrode to be rotatable with respect to the ground electrode, it is preferably provided that one end of the center electrode facing away from the combustion chamber is rotationally symmetric with respect to the longitudinal axis of the spark plug. This end facing away from the combustion chamber is inserted into a panat of the spark plug. The center electrode is inserted into the panat in such a way that the center electrode is rotatable with respect to the panat. It is preferred in particular that the surface of the end of the center electrode facing away from the combustion chamber is wetted using a lubricant, so that the center electrode remains rotatable with respect to the panat after the panat is stuck. This lubricant is designed in such a way that it is electrically conductive and heat-resistant, and does not react chemically with the panat.

Furthermore, a tool recess is provided on the combustion chamber side of the center electrode. For example, this tool recess is designed as a hexagon socket, a slot or a cross-slot. A tool may be fitted into this tool recess for adjusting the distance between the spark surfaces using a tool. Turning the tool rotates the center electrode coaxially to the longitudinal axis of the spark plug with respect to the ground electrode. In particular, this tool recess is formed on a combustion chamber-side end of the center electrode.

The present invention furthermore includes a swirl chamber spark plug. This swirl chamber spark plug is designed similarly to the spark plug described above, and has in addition a cap situated on the combustion chamber side. This cap situated on the combustion chamber side is in particular connected to a housing of the spark plug. A swirl chamber is formed in the interior of the cap. Thus, the cap covers at least partially the combustion chamber-side end of the center electrode and the ground electrode. The advantageous embodiments described in connection with the spark plug according to the present invention accordingly are advantageously applied to the swirl chamber spark plug according to the present invention.

It is preferably provided that the ground electrode is connected non-rotatably to the cap and the cap is rotatable coaxially to the longitudinal axis with respect to the center electrode for setting the distance between the first spark surface and the second spark surface. In particular, the ground electrode is also connected to the cap in an electrically conductive manner. The cap is in turn connected to the housing of the swirl chamber spark plug in an electrically conductive manner. For the rotatability of the cap and consequently the rotatability of the ground electrode, the cap is preferably rotatably connected to the housing of the swirl chamber spark plug.

In addition or alternatively to the rotatable system of the cap and the ground electrode, it is possible to form the center electrode to be rotatable in the case of the swirl chamber spark plug. In particular, a tool opening is provided in the cap for this purpose. A tool may be inserted into this tool opening for turning the center electrode. In particular, this tool opening is situated on a combustion chamber-side end of the cap. It is preferred in particular that the longitudinal axis of the swirl chamber spark plug passes through this tool opening. This makes it possible to coaxially engage in the tool recess of the center electrode using a tool.

Since the adjustment or setting of the distance, at least in the case of the swirl chamber spark plug, must be made without sight of the distance between the spark surfaces, the following steps are preferably proposed for setting the distance: The center electrode and/or the ground electrode is/are initially rotated until the first spark surface contacts the second spark surface. The appropriate resistance to be measured in this case between the center electrode and the ground electrode is 0Ω. In a next step, the ground electrode and/or the center electrode is/are set back by a certain angle, so that the electrode distance is the predefined or desired amount.

BRIEF DESCRIPTION OF THE DRAWINGS

FIG. 3 shows a detailed view from FIG. 2.

FIG. 4 shows a section parallel to the longitudinal axis of the spark plug according to the present invention, according to the first exemplary embodiment.

DETAILED DESCRIPTION OF THE INVENTION

A spark plug 1, designed as a swirl chamber spark plug, is explained in greater detail below with reference to FIGS. 2 and 3 for both exemplary embodiments.

Figure 5:
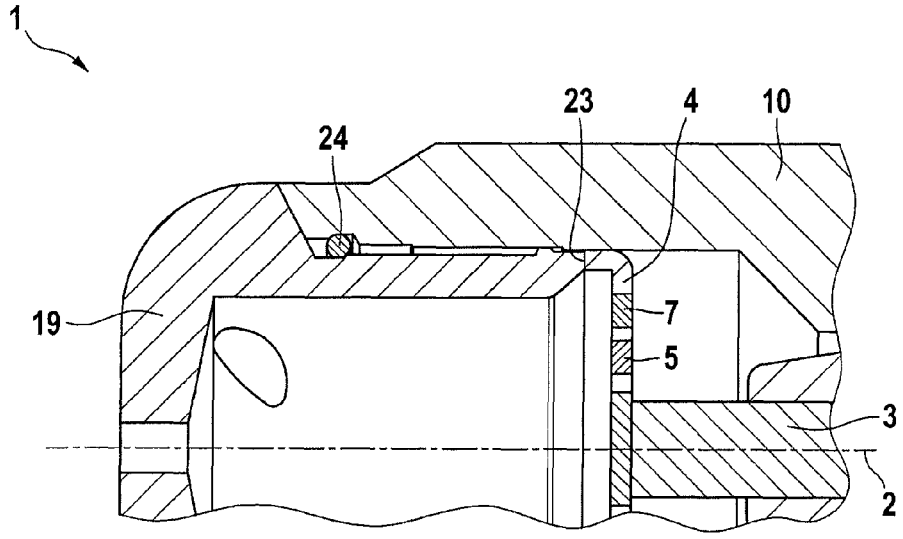
FIG. 5 shows a section parallel to the longitudinal axis of the spark plug according to the present invention, according to the second exemplary embodiment.

FIG. 4 shows the special design of spark plug 1 according to the first exemplary embodiment. FIG. 5 shows the special design of spark plug 1 according to the second exemplary embodiment. Details of both exemplary embodiments are explained with reference to FIG. 6. Identical or functionally identical components are provided with the same reference numerals in all exemplary embodiments.

Figure 1:
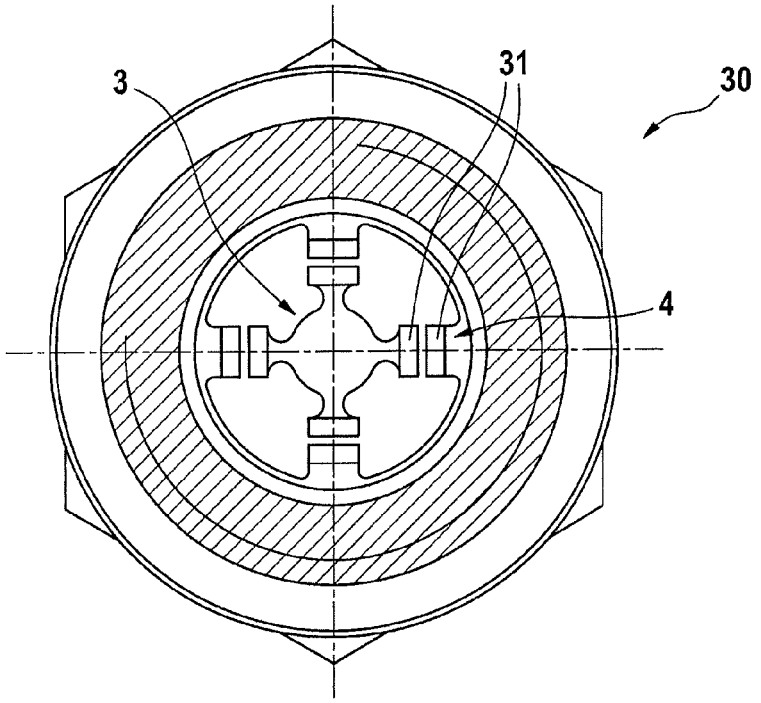
FIG. 1 shows a section perpendicular to the longitudinal axis of a known spark plug.
Figure 2:
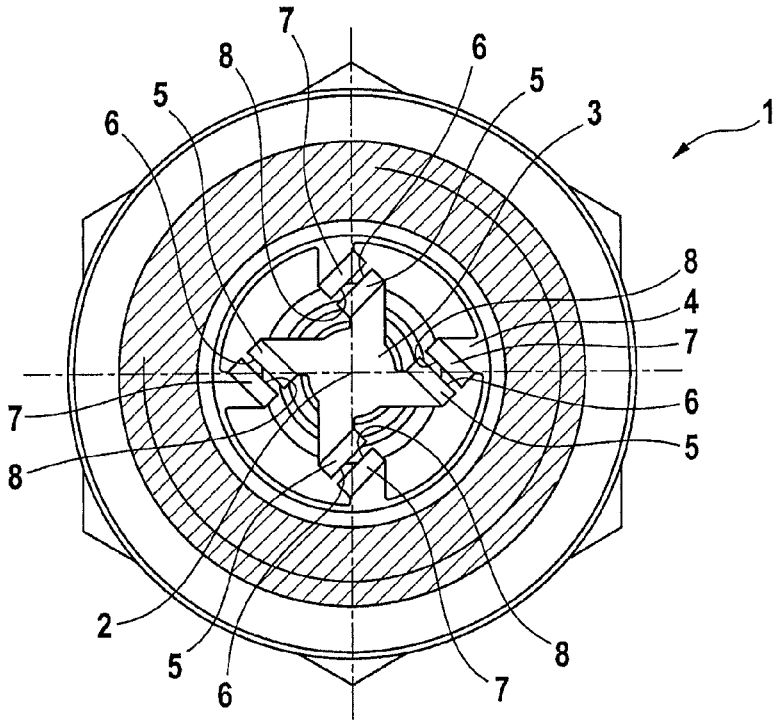
FIG. 2 shows a section perpendicular to the longitudinal axis of a spark plug according to the present invention, according to a first and second exemplary embodiment.

FIG. 2 shows spark plug 1. A section through a longitudinal axis 2 of spark plug 1 is shown. Spark plug 1 includes a center electrode 3 and a ground electrode 4. Four first small stainless steel plates 5 are formed on center electrode 3. A first spark surface 6 is situated on each of small stainless steel plates 5. Ground electrode 4 includes four second small stainless steel plates 7. A second spark surface 8 is formed on each of second small stainless steel plates 7. This results in four pairs of spark surfaces. Each first spark surface 6 is diametrically opposed to a second spark surface 8. First and second spark surfaces 6, 8 are each designed to be planar.

FIG. 3 shows a detail from FIG. 2. A distance 18 is plotted in FIG. 3. The planar design of first and second spark surfaces 6, 8 and their parallel positioning causes distance 18 to be constant across the entire surface of spark surfaces 6, 8. Furthermore, FIG. 3 shows an imaginary plane 9. Longitudinal axis 2 lies in this plane 9. Furthermore, plane 9 bisects particular first or second spark surface 6, 8 in the center. In the example shown here, plane 9 is plotted for shown second small stainless steel plate 7 on ground electrode 4 and consequently for second park surface 8. FIG. 3 shows an angle α between this plane 9 and second spark surface 8. The smaller angle is measured in each case. In the two exemplary embodiments presented here all spark surfaces 6, 8 are inclined with respect to imaginary plane 9 by the same angle α.

Turning center electrode 3 and/or ground electrode 4 coaxially to longitudinal axis 3 changes distance 18 between first spark surface 6 and second spark surface 8. For example, after a certain amount of wear of small precious metal plates 5, 7, this makes it possible to readjust distance 18. The inclination of spark surfaces 6, 8 by angle α and the planar and parallel design of spark surfaces 6, 8 causes spark surfaces 6, 8 to be displaced approximately parallel to one another when distance 18 is set.

FIG. 4 shows the configuration of spark plug 1, designed as a swirl chamber spark plug, of the first exemplary embodiment. A housing 10, an insulator 11, a panat 12 and a cap 19 are shown as an additional integral part of spark plug 1. With the aid of housing 10, spark plug 1 is screwed into, for example, a stationary gas engine. Housing 10 establishes here the ground contact to the gas engine. A center electrode 3 is situated in housing 10. Center electrode 3 engages panat 12 in an electrically conductive manner. Panat 12 and center electrode 3 are insulated from housing 10 with the aid of insulator 11. FIG. 4 furthermore shows a combustion chamber side 14 and a side 15 of spark plug 1 facing away from the combustion chamber. Consequently, an end 13 facing away from the combustion chamber is defined on center electrode 3. This end 13 of center electrode 3 facing away from the combustion chamber is designed to be rotationally symmetric with regard to longitudinal axis 2 and is rotatable with respect to panat 12. For this purpose, for example, a lubricant is used between end 13 facing away from the combustion chamber and panat 12. To prevent center electrode 3 from slipping out of panat 12 or from insulator 11, end 13 facing away from the combustion chamber has a shoulder 16. Using this shoulder 16, center electrode 3 is supported on insulator 11.

Cap 19 is fixedly connected to the combustion chamber side of housing 10. Thus, cap 19 forms a swirl chamber 20. Ground electrode 4 and a combustion chamber-side portion of center electrode 3 are situated in this swirl chamber 20. Furthermore, cap 19 has a tool opening 21. This tool opening 21 is designed to be coaxial to longitudinal axis 2. On its combustion chamber-side end, center electrode 3 has a tool recess 17, which is designed as a slot. Via tool opening 21, a tool 22 may be introduced into swirl chamber 20. Using tool 22, it is possible to engage center electrode 3 in tool recess 17 and thus turn center electrode 3 using tool 22.

FIG. 4 shows spark plug 1 designed as a swirl chamber spark plug according to the second exemplary embodiment. In this case, cap 19 is rotatably situated with respect to housing 10. For a tight seal between cap 19 and housing 10, a ring 24 is provided. Via a weld connection 23, ground electrode 4 is connected to cap 19 in a non-rotatable and electrically conductive manner. Consequently, ground electrode 4 may be turned by rotating cap 19 coaxially about longitudinal axis 2.

Alternatively or in addition, it is also possible in the second exemplary embodiment to situate center electrode 3 to be rotatable in a manner, for example, which is similar to the first exemplary embodiment.

Rotatable center electrode 3 and/or rotatable ground electrode 4 are situated using a self-locking rotary joint, so that a set distance 18 does not change independently, for example, in the case of vibrations.

Figure 6:
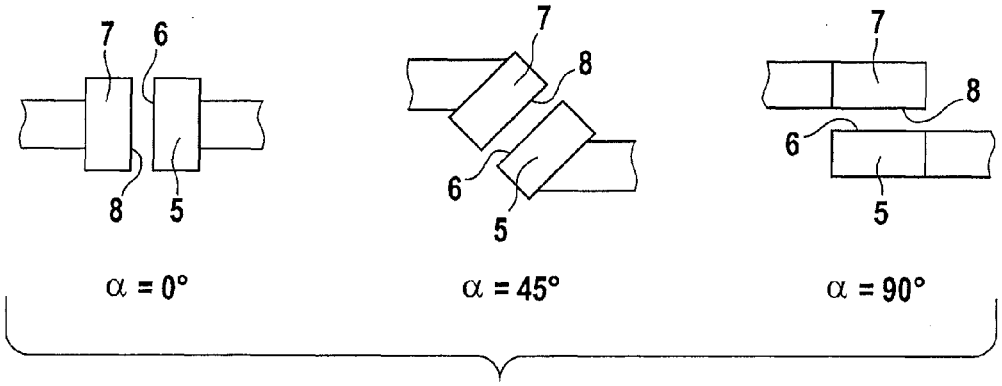
FIG. 6 shows different embodiments of the electrodes for the spark plug of the first and second exemplary embodiments according to the present invention.

FIG. 6 shows different designs of angle α for both exemplary embodiments. The left diagram in FIG. 6 shows angle α at 0°, as it is present in the related art. In this case small precious metal plates 5, 7 are in the so-called "tangential" position. The center and the right diagram show how angle α may be formed according to the present invention. Thus, angle α amounts to, for example, approximately 45° and may amount to as much as 90°.

What is claimed is:

1. A spark plug, comprising:

a center electrode including at least one first spark surface, the center electrode extending along a longitudinal axis of the spark plug; and a ground electrode including at least one second spark surface, wherein the first spark surface is situated diametrically opposed to the second spark surface, so that an ignition spark is generated between the first spark surface and the second spark surface;

wherein the ground electrode is rotatable coaxially to the longitudinal axis with respect to the center electrode; and wherein the first spark surface and the second spark surface are inclined in such a way that at least one of rotating the center electrode with respect to the ground electrode and rotating the ground electrode with respect to the center electrode sets a distance between the first spark surface and the second spark surface.

2. The spark plug as recited in claim 1, wherein the first spark surface and the second spark surface are inclined to a plane at angle, the longitudinal axis lying in the plane, and the plane bisecting the center of the respective spark surface, and the angle being between 5° and 90°.

3. The spark plug as recited in claim 2, wherein the first spark surface is formed on a first precious metal plate of the center electrode, and the second spark surface is formed on a second precious metal plate of the ground electrode.

4. The spark plug as recited in claim 3, wherein each of the first spark surface and the second spark surface is one of a planar surface or a rounded surface.

5. The spark plug as recited in claim 1, wherein multiple first spark surfaces are distributed on the circumference of the center electrode, and multiple second spark surfaces are distributed on the circumference of the ground electrode.

6. The spark plug as recited in claim 1, wherein one end of the center electrode facing away from the combustion chamber is (i) rotationally symmetric with respect to the longitudinal axis and (ii) rotatably inserted into a panat.

7. The spark plug as recited in claim 1, wherein the center electrode is rotatable coaxially to the longitudinal axis with respect to the ground electrode.

8. A spark plug, comprising:

a center electrode including at least one first spark surface, the center electrode extending along a longitudinal axis of the spark plug; and a ground electrode including at least one second spark surface, wherein the first spark surface is situated diametrically opposed to the second spark surface, so that an ignition spark is generated between the first spark surface and the second spark surface;

wherein at least one of (i) the center electrode is rotatable coaxially to the longitudinal axis with respect to the ground electrode, and (ii) the ground electrode is rotatable coaxially to the longitudinal axis with respect to the center electrode; and wherein the first spark surface and the second spark surface are inclined in such a way that at least one of rotating the center electrode with respect to the ground electrode and rotating the ground electrode with respect to the center electrode sets a distance between the first spark surface and the second spark surface wherein a combustion chamber-side tool recess is provided on the center electrode, the center electrode being rotatable coaxially to the longitudinal axis with respect to the ground electrode with the aid of the tool recess.

9. A swirl chamber spark plug for a stationary gas engine, comprising:

a spark plug including:

a center electrode including at least one first spark surface, the center electrode extending along a longitudinal axis of the spark plug; and a ground electrode including at least one second spark surface, wherein the first spark surface is situated diametrically opposed to the second spark surface, so that an ignition spark is generated between the first spark surface and the second spark surface;

wherein the ground electrode is rotatable coaxially to the longitudinal axis with respect to the center electrode; and wherein the first spark surface and the second spark surface are inclined in such a way that at least one of rotating the center electrode with respect to the ground electrode and rotating the ground electrode with respect to the center electrode sets a distance between the first spark surface and the second spark surface; and a cap situated on the combustion chamber side of the spark plug for forming a swirl chamber.

10. The swirl chamber spark plug as recited in claim 9, wherein the center electrode is rotatable coaxially to the longitudinal axis with respect to the ground electrode.

11. A swirl chamber spark plug for a stationary gas engine, comprising:

a spark plug including:

a center electrode including at least one first spark surface, the center electrode extending along a longitudinal axis of the spark plug;

a ground electrode including at least one second spark surface, wherein the first spark surface is situated diametrically opposed to the second spark surface, so that an ignition spark is generated between the first spark surface and the second spark surface;

wherein at least one of (i) the center electrode is rotatable coaxially to the longitudinal axis with respect to the ground electrode, and (ii) the ground electrode is rotatable coaxially to the longitudinal axis with respect to the center electrode, wherein the first spark surface and the second spark surface are inclined in such a way that at least one of rotating the center electrode with respect to the ground electrode and rotating the ground electrode with respect to the center electrode sets a distance between the first spark surface and the second spark surface; and a cap situated on the combustion chamber side of the spark plug for forming a swirl chamber, wherein the ground electrode is connected non-rotatably to the cap, and the cap is rotatable coaxially to the longitudinal axis with respect to the center electrode for setting the distance between the first spark surface and the second spark surface, wherein a tool opening is provided in the cap, and wherein the tool opening accommodates a tool inserted through the tool opening for rotating the center electrode.

* * * * *